United States Patent [19]

Banura

[11] Patent Number: 4,972,136

[45] Date of Patent: Nov. 20, 1990

[54] LINEAR POWER REGULATOR WITH CURRENT LIMITING AND THERMAL SHUTDOWN AND RECYCLE

[75] Inventor: George A. Banura, Ridgecrest, Calif.

[73] Assignee: The United States of America as represented by the Secretary of the Navy, Washington, D.C.

[21] Appl. No.: 432,832

[22] Filed: Nov. 7, 1989

[51] Int. Cl.[5] ..... G05F 1/565

[52] U.S. Cl. ..... 323/275; 323/281

[58] Field of Search ..... 323/273, 274, 275, 277, 323/279, 280, 281

[56] References Cited

U.S. PATENT DOCUMENTS

| | | | |
|---|---|---|---|
| 3,173,078 | 3/1965 | Farnsworth | 323/9 |
| 3,399,338 | 8/1968 | Burgert et al. | 323/277 |
| 3,480,852 | 11/1969 | Hung | 323/279 |
| 3,579,089 | 5/1971 | Giess | 323/279 |
| 3,723,774 | 3/1973 | Rogers | 323/277 |
| 3,959,713 | 5/1976 | Davis et al. | 323/9 |
| 3,988,643 | 10/1976 | Morris | 323/277 |
| 4,180,768 | 12/1979 | Ferraro | 323/9 |
| 4,288,831 | 9/1981 | Dolikian | 323/282 |
| 4,340,851 | 7/1982 | Nishikawa | 323/311 |
| 4,521,726 | 7/1985 | Budnick | 323/283 |
| 4,531,084 | 7/1985 | Hoffman | 323/278 |
| 4,618,813 | 10/1986 | Vesce et al. | 323/278 |
| 4,669,026 | 5/1987 | Widlar | 323/279 |
| 4,672,302 | 6/1987 | DeShazo et al. | 323/277 |
| 4,678,984 | 7/1987 | Henze | 323/277 |
| 4,800,331 | 1/1989 | Vesce et al. | 323/279 |
| 4,814,687 | 3/1989 | Walker | 323/275 |

*Primary Examiner*—Ian J. Lobo

*Attorney, Agent, or Firm*—Harvey A. Gilbert; Melvin J. Sliwka; Sol Sheinbein

[57] ABSTRACT

A power supply has the source and drain of a MOSFET arranged for connection between an input voltage source and a load. In normal operation a bias voltage is applied to the gate to place the MOSFET in a conductive state. A difference amplifier maintains a fixed ratio between a reference voltage and the output voltage. Current limiting circuitry senses the current that the power supply provides to the load and disables the MOSFET when the current provided to the load exceeds a predetermined value. Thermal shutdown circuitry senses the operating temperature of the power supply and places the MOSFET in a nonconductive state when the operating temperature exceeds a predetermined value.

5 Claims, 1 Drawing Sheet

LINEAR POWER REGULATOR WITH CURRENT LIMITING AND THERMAL SHUTDOWN AND RECYCLE

BACKGROUND OF THE INVENTION

1. Field of the Invention

This invention relates generally to power supplies and particularly to electronic circuits for controlling the output of power supplies to provide defined output voltage and current to devices connected to the power supply and to prevent damage to both the power supply and devices connected thereto.

2. Description of the Prior Art

Previous power regulation devices use either a linear or a switching technique for providing electric power having defined voltage and current. Both the linear and the switching regulators have deficiencies that render them unattractive for certain applications.

A switching regulator operates by chopping the unregulated DC supply voltage using a saturated transistor switch and then filtering the chopped voltage. The output voltage is regulated by varying the duty cycle of the transistor. Switching regulators tend to be lightweight, compact and efficient. Switching regulators are limited in transient response by the switching frequency, and are therefore usually slower than linear regulators (milliseconds versus microseconds). In some systems, such as radio frequency circuits, a switching regulator cannot be used because of its high switching noise. Therefore, such systems typically include highly dissipative linear regulators which avoid excessive noise but present problems associated with thermal stresses and heat dissipation.

Compared to switching regulators, linear regulators are simpler and have much lower output noise but are much less efficient at low voltages such as 5 volts, for example. Existing linear regulators using bipolar transistors require a 3 V input-output differential for proper operation. The resulting power dissipation is $31_o$ volts, where $I_o$ is the current output from the regulator. For a 10 amp output current, which is typical for many radio frequency systems, the minimum power dissipation in the regulator is 10 watts.

U.S. Pat. No. 3,173,078, which issued Mar. 9, 1965 to Farnsworth, is directed to an overload protective power supply that includes an overload sensing curcuit. Farnsworth discloses a power supply having a tunnel diode coupled in a load current path for sensing the load current. A switching transistor is connected between the tunnel diode and a voltage comparator for disconnecting the load from the power supply when the voltage across the tunnel diode indicates an overload condition.

U.S. Pat. No. 3,959,713, which issued May 25, 1976 to Davis et al., is directed to a current limit circuit for limiting the current drain of a series connected load by switching the current limiting circuit from a low impedance state to a high impedance state in response to an overload to prevent excessive power dissipation by the load. Davis et al. dicloses switching circuitry for switching a current limiting transistor from low impedance to high impedance in response to an overload, which limits the current to a predetermined acceptable magnitude. Davis et al. also discloses a thermal resonse circuit that renders the current limiting circuit inoperative when the temperature exceeds a predetermined value. The thermal shutdown circuit includes temperature-sensitive circuitry for switching the current limiting transistor to its high impedance state when the temperature increases to a predetermined value.

U.S. Pat. No. 4,180,768, which issued Dec. 25, 1979 to Ferraro, is directed to an energy limiting foldback circuit for use with a power supply having a power control device in its output. The energy limiting circuit includes a voltage sensor for sensing the voltage between the input and the output of the power control device. A latch places the power control device in a nonconductive state, and a pulse generator periodically places the power control device in a momentary conduction state constrained by the upper current limit of the current that is to be permitted in the output.

U.S. Pat. No. 4,288,831, which issued Sept. 8, 1981 to Dolikian, discloses a switch mode power supply in which a feedback loop varies the duty cycle of a voltage controlled oscillator to control the DC voltaqe output.

U.S. Pat. No. 4,340,851, which issued July 20, 1982 to Nishikawa, is directed to a powerless start circuit for self-biased circuits. A resistive element provides a current path from the supply voltage to the self-biased circuit and a field effect transistor. The transistor responds to the flow of current through the resistor and supplies an initial current to the self-biased circuit. Regenerative feedback causes the circuit to draw a current related to the biasing currents through the current path as the bias currents reach their non-zero operating points. The transistor shuts off the initial current to the self-biased circuit as the nonzero operating point is reached so that the start-up circuit is effectively disconnected from the biasing circuit.

U.S. Pat. No. 4,521,726, which issued June 4, 1985 to Budnick, is directed to control circuitry for a pulse width modulated switching power supply. A pulse generator provides a train of pulses at a predetermined repetition frequency, and a signal source generates a reference voltage. A comparator compares the power supply output to the reference voltage and produces a first state of a switching control signal in response to each trigger pulse from the pulse generator. The comparator produces a second state of the switching control signal when the power supply voltage equals the reference voltage. The first state of the switching signal enables switching transistors in the power supply, and the second state disables the switching transistors. The comparator includes circuitry for reducing the reference voltage when the transistors are disabled to prevent them from being reenabled until the next trigger pulse from the pulse generator changes the state of the control signal.

SUMMARY OF THE INVENTION

The present invention overcomes the deficiencies of the prior art by using a MOSFET to provide a power supply having increased efficiency and by providing protection features that make the power supply virtually indestructible. A power supply according to the present invention has a power dissipation that is about a factor of twelve less than that of conventional voltage regulators using bipolar transistors. The present invention therefore provides a linear regulator having an efficiency greater than that of switching regulators.

The power supply according to the present invention preferably includes a highly stable voltage reference that results in an output voltage variation of less than 1% over the full operating temperature range. The present invention also preferably includes a low loss current limiter with a very sharp cutoff and high temperature stability. The present invention also preferably has the advantage of including precise and accurate thermal shutdown circuit.

A power supply according to the present invention has an input terminal and an output terminal for connection between an input voltage source and a load to provide an output voltage and current to the load. The power supply according to the present invention comprises a MOSFET having its source and drain arranged for connection between the input voltage source and the load. The present invention includes means for applying a bias voltage to the gate to place the MOSFET in a conductive state, means for providing a reference voltage, and means for maintaining a fixed ratio between the reference voltage and the output voltage.

The means for maintaining a fixed ratio between the reference voltage and the output voltage preferably comprises a difference amplifier connected to the output terminal, to the reference voltage source and to the MOSFET.

A power supply according to the present invention preferably includes current limiting circuitry that includes means for sensing the current that the power supply provides to the load and means for switching off the power supply when the current provided to the load exceeds a predetermined value. The current limiting circuitry preferably includes a comparator connected to the input terminal and current regulating means connected to the MOSFET for establishing a reference current. The present invention preferably includes switch means controlled by the comparator and connected between the gate of the MOSFET and ground for placing the MOSFET in a nonconductive state when the comparator means produces a signal indicating that the load current has exceeded a predetermined value.

The power supply according to the present invention also preferably comprises thermal shutdown circuitry that includes temperature sensing means for sensing the operating temperature of the power supply and thermal shutdown means for switching off the power supply when the operating temperature exceeds a predetermined value. The thermal shutdown circuitry also preferably includes a temperature-dependent electrical signal source connected to the input terminal and a switch controlled by the temperature-dependent electrical signal source and having terminals connected between the gate of the MOSFET and ground for placing the MOSFET in a nonconductive state when the temperature-dependent electrical signal souce produces a signal indicating that the operating temperature has exceeded a predetermined value.

DESCRIPTION OF THE PREFERRED EMBODIMENT

Figure 1:
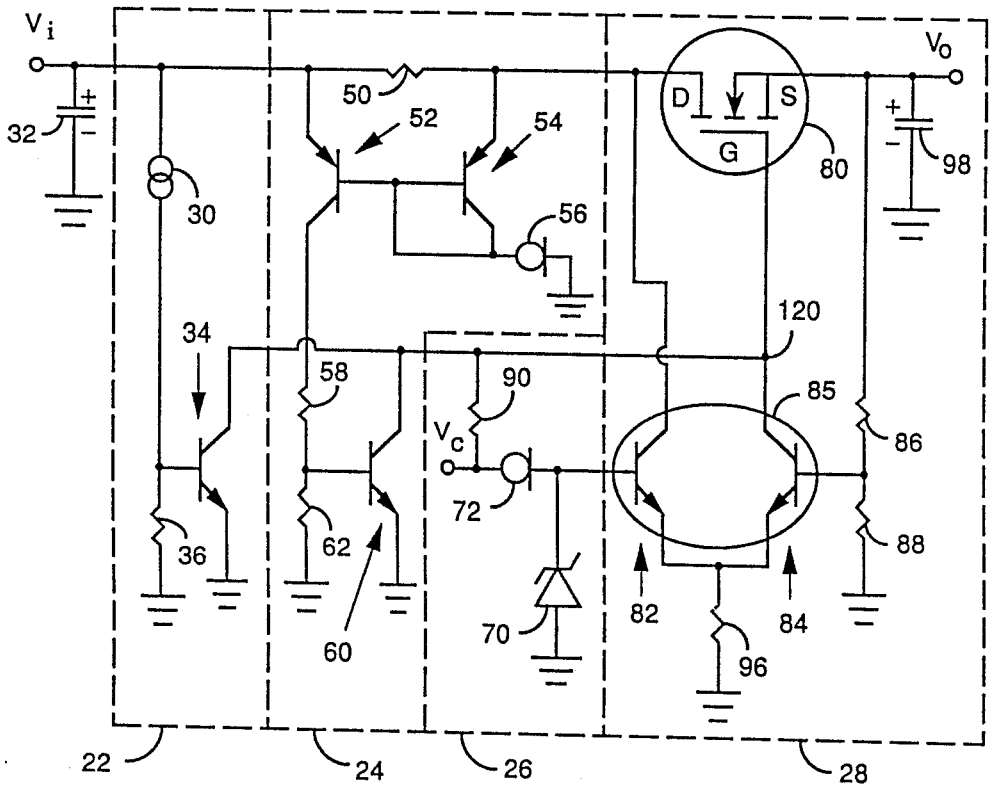
FIG. 1 is a schematic diagram showing a thermal shutdown circuit, a current limiter, a voltage reference and a voltage regulator according to the present invention.

Referring to FIG. 1, a high efficiency, high current power supply 20 includes a thermal shutdown circuit 22, a current limiting circuit 24, a voltage reference circuit 26 and a linear voltage regulator 28.

The thermal shutdown circuit 22 may include a temperaturedependent current source 30 that is connected to an input voltage $V_i$. The input voltage is also connected to a capacitor 32, which may have a capacitance of about 22 $\mu$f.

The current output from the current source 30 is input to the base of a transistor 34. The embodiment of FIG. 1 shows the transistor 34 to be an npn transistor with a grounded emitter. A resistor 36 is connected between the base of the transistor 34 and ground. The collector of the transistor 34 is connected to the voltage regulator 28 as explained subsequently.

The current source 30 may be an AD590, which produces an electric current having a magnitude proportional to the ambient temperature. The resistor 36 is a current sense resistor that senses the temperature-dependent current output from the current source 30. For proper operation, the transistor 34 and the current source 30 must be thermally bonded to the surface where the temperature is to be sensed. The voltage across the resistor 36 is $$V(R_{36})=(273+T_j)R_1\times 10^{-6} \quad (1)$$

where $T_j$ is the junction temperature.

Instead of the npn transistor 34 of FIG. 1, the thermal shutdown circuit 22 may include a pnp transistor (not shown) connected in essentially the same manner as the transistor 34. When a pnp transistor is used in the thermal shutdown circuit 22, the polarity of the current souce 30 is reversed from that shown in FIG. 1.

Figure 2:
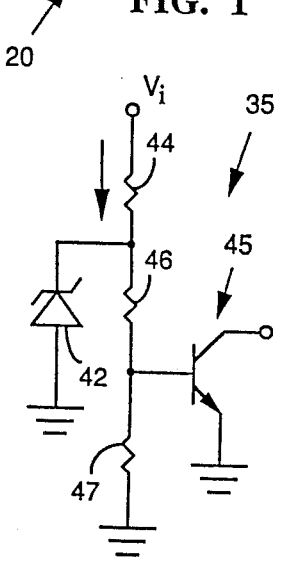
FIG. 2 is a schematic diagram of a thermal shutdown circuit which may be employed in place of the thermal shutdown circuit and FIG. 3 is a schematic diagram of a voltage regulator which may be employed in place of the voltage regulator in FIG. 1.

The power supply 20 of FIG. 1 may use a thermal shutdown circuit 35 of FIG. 2 as an alternative to the thermal shutdown circuit 22 of FIG. 1. The thermal shutdown circuit 35 includes a temperature-dependent voltage source 42, which may be an LM135M Zener diode. The voltage output of the voltage source 42 is dependent upon the ambient temperature. The LM135A is less expensive than the AD590, which may determine which of the thermal shutdown circuits is preferable for use in the power supply 20. The cathode of the Zener diode 42 is connected between a pair of resistors 44 and 46. The anode of the Zener diode 42 is grounded. The input voltage $V_i$ is applied to the resistor 44, the other end of which is connected to the cathode of the Zener Diode 42 and one end of the resistor 46. The opposite end of the resistor 46 is connected to the base of a transistor 45 and to a resistor 47, which is connected between the base of the transistor 45 and ground. In the circuit of FIG. 2, the voltage across the resistor 47 is give by $$V(R_{47}) = \frac{R_{47}}{R_{47} + R_{46}} (273 + 0.01\ T_j) \quad (2)$$

The Zener diode 42 of FIG. 2 may be reversed in polarity and the transistor 45 may be replaced by a pnp transistor (not shown).

Equations (1) and (2) show that the AD590 and LM135A have positive temperature coefficients. The base-to-emitter voltage $V_{be}$ of the transistor 34 has a negative temperature coefficient. For a typical bipolar transistor suitable for use in the thermal shutdown circuit 22, $V_{be}$ is given by $$V_{be}=0.65-0.0022T_j. \quad (3)$$

The shutdown temperature for the power supply 20 is the temperature at which the transistor 34 in FIG. 1 turns on. Since the transistor 34 will turn on when the voltage across the resistor 36 is greater than or equal to the base to emitter voltage of the transistor 34, then the temperature at which the transistor 34 turns on is found by equating Equations (1) and (3) for the AD590 or Equations (2) and (3) for the LM135A. The results are:

$$T_j\,(AD590) = \frac{65000 - 273\,R_{36}}{2200 + R_{36}} \quad (4)$$

$$T_j\,(LM135A) = \frac{0.65\,\frac{R_2}{R_{47}} - 2.08}{0.0022\,\frac{R_2}{R_{47}} + 0.0122} \quad (5)$$

Equations (4) and (5) allow the computation of the shutdown temperature for given values of the resistors 36 and 46. The required values of the resistors 36 and 46 that result in a given shutdown temperature are found using the equations:

$$R_{36}\,(AD590) = \frac{65000 - 2200\,T_j}{273 + T_j} \quad (6)$$

$$\frac{R_2}{R_{36}}\,(LM135A) = \frac{2.08 + 0.0122\,T_j}{0.65 - 0.0022\,T_j} \quad (7)$$

An important feature in the operation of the thermal shutdown circuit 22 is the opposite signs of the temperature coefficients of the AD590 used for the temperature-dependent current source 30 and the transistor 34. As the junction temperature $T_j$ increases, the voltage $V(R_{36})$ increases while $V_{be}$ of the transistor 34 decreases. Shutdown occurs when $V(R_{36})=V_{be}$. However, due to heat inertia, the temperature tends to climb a small amount following shutdown, which results in latching the shutdown mode to prevent oscillations. After the temperature falls below the cutoff temperature, the transistor 34 turns off.

The shutdown circuitry described above has a hysteresis of about 2%, which is excellent. The temperature coefficients of the LM135A used for the temperature-dependent voltage source 42 and the transistor 45 are also opposite in sign so that an analysis similar to that above applies to the thermal shutdown circuit 35 shown in FIG. 2.

The current limiting circuit 24 includes a current sense resistor 50 that is connected between the emitters of a pair of pnp transistors 52 and 54. The bases of the transistors 52 and 54 are connected together. The transistors 52 and 54 are preferably a dual matched pair that are packaged together as a 2N3811. Such transistors are readily available. The input voltage $V_i$ is applied to the emitter of the transistor 52, which is used as a comparator. The base and collector of the transistor 54 are directly connected together so that the transistor 54 is used as a diode for providing a reference voltage to the transistor 52.

The anode of a diode 56 is connected to the base and emitter of the transistor 54 and to the base of the transistor 52. The cathode of the diode 56 is grounded. The diode 56 may be a 1N5283 current regulating diode that provides a constant current of 0.2 ma to the base of the transistor 52.

One end of the resistor 58 is connected to the collector of the transistor 52. A transistor 60, which may be a 2N222, is connected to the other end of the resistor 58 such that the resistor 58 is connected between the base of the transistor 60, and the collector of the transistor 52. The emitter of the transistor 60 is grounded, and a resistor 62 that typically has a resistance of about 240 Ω is connected between the base of the transistor 60 and ground. The transistor 60 is used as a voltage controlled switch with its collector and emitter serving as the switch terminals. For the components described herein, the switch is turned on when the voltage across the resistor 62 exceeds 0.65 volts.

The current $I_o$ through the current sense resistor 50 drops a voltage equal to the current $I_o$ times the resistance $R_s$ of the current sense resistor 50. When the voltage across the current sense resistor 50 plus the base emitter voltage of the transistor 54 becomes larger than the base to emitter voltage of the transistor 52, then the transistor 52 is conductive and remains conductive until its collector current reaches a value large enough to turn on the transistor 60. If the resistance of the resistor 62 is 240 Ω, and the voltage required to turn on the transistor 60 is 0.65 volts, then, using 240 Ω, and the voltage required to turn on the transistor 60 is 0.65 volts, then, using Ohm's law, a collector current of 2.7 ma in the transistor 52 would cause the transistor 60 to turn on. Therefore, to turn on the transistor 60 requires a current $I_{o(limit)}$ equal to the difference of the base to emitter voltages of the transistors 52 and 54 divided by the resistance $R_s$ of the current sense resistor.

A suitable current limiting circuit may for negative voltages be formed by using a 2N2920 as the matched transistor pair. The only essential difference between the 2N3811 and the 2N2920 is that the 2N3811 includes pnp transistors while the 2N2920 includes npn transistors. If the 2N2920 is used in the current limiting circuit 24, then the transistor 60 should be a pnp transistor such as the 2N2907A.

The collector current of the transistor 54 is approximately constant at 0.22 ma, and the collector current of the transistor 52 is approximately constant at 2.7 ma. Therefore, for the transistor 52 the base to emitter voltage $V_{be}$—0.668 volts at a current of 2.7 ma, and for the transistor 54 the base to emitter voltage $V_{be}=0.608$ volts at a current of 0.22 ma. Using the data for the 2N2920, the current limit is $$I_o\,(\text{limit}) = \frac{0.668 - 0.608}{R_s} = \frac{0.060}{R_s} \quad (8)$$

which is a constant. Because the base to emitter voltages of the transistor 52 and 54 are matched such that their difference is less than or equal to 2 mv over the temperature range of interest, which is −55° C. to 125° C., then the variation of $I_o$(limit) is 2/60=3.3%. Therefore, the $I_o$ (limit) is very stable with temperature.

The resistance of the resistor 58 should be selected such that the transistor 60 will have an overdrive factor of about three when the transistor 52 is saturated. This overdrive factor results in latching the shutdown for a few milliseconds and prevents oscillations. Therefore, the resistor 58 should be selected as follows:

$$\frac{V_{in} - V_{be}}{R_{58}} = \frac{3\,V_{be}}{R_{62}} \tag{9}$$

or $$\frac{R_{58}}{R_{62}} = \frac{V_{in}}{V_{be}} - 0.333 \tag{10}$$

Referring to FIG. 1, the voltage reference circuit 26 preferably includes a Zener diode 70 having its anode grounded and its cathode connected to the cathode of a diode 72. The Zener diode 70 may be a 1N4569A, which is a low level, temperature-compensated Zener reference diode having a voltage of 6.4 volts at 0.5 ma of Zener current. The diode 72 is preferably a current regulator diode such as the IN5290, which has an output current of 0.47ma+10%). The IN4569A Zener diode 70 is a precise voltage reference provided that its current is held approximately constant at 0.5 ma. The IN5290 provides a constant current of 0.47 ma to the IN4569A diode 72. The combination of the IN4569A and the IN5290 results in a very highly stable voltage reference that varies less than 0.5% within the temperature range of interest.

Referring again to FIG. 1, the voltage regulator 28 is suitable for providing an output voltage of 15 volts. The voltage regulator 28 preferably includes an N-channel MOS power transistor 80. The transistor 80 preferably is an SMM70N06, which has a drain to source resistance $R_{ds(on)}=0.018\ \Omega$. The transistor 80 functions as a series pass transistor for the regulator. The drain and gate of the transistor 80 are connected to the collectors of a pair of transistors 82 and 84, respectively. The transistors 82 and 84 preferably are a matched pair such as the 2N2920. The transistors 82 and 84 are connected together so that they form a difference amplifier 85.

The output voltage $V_o$ is taken at the source of the transistor 80. A resistor 86 is connected between the source of the transistor 80 and the base of the transitor 84. Another resistor 88 is connected between the base of the transistor 84 and ground. The resistors 86 and 88 preferably have resistances of about 3.92 KΩ and 3.01 KΩ, respectively.

A source of an input control voltage $V_c$ is connected to a resistor 90 that is connected to the gate of the transistor 80. This voltage provides a bias to the gate so that current may flow between the drain and source of the transistor 80. The resistor 90 may have a resistance of about 5.1 KΩ. The control voltage $V_c$ should be equal to at least the output voltage $V_o$+6 volts. The control voltage $V_c$ is also applied to the anode of the diode 72, the cathode of which is connected to the base of the transistor 82. The Zener diode 70 has its cathode connected to the cathode of the diode 72 and to the base of the transistor 82. The Zener diode 70, which may be a 1N4569A, provides an internal voltage reference of 6.4 volts against which the output voltage $V_o$ is compared by the difference amplifier 85.

The diode 72 and the resistances of the resistors 86 and 88 establish the exact value of the output voltage. A resistor 96 is connected between the emitters of the transistors 82 and 84 and ground to establish a constant bias current in the difference amplifier 85. The resistor 90 determines the cut-off condition of the transistor 80 and controls the internal regulation function. The resistor 96 may have a resistance of about 3.6 KΩ.

A capacitor 98 is connected between the source of transistor 80 and ground. The capacitors 32 and 98 at the input and output, respectively, are bypass capacitors used to provide loop stability. Both the capacitors 32 and 98 preferably have capacitances of about 22 uf.

Figure 3:
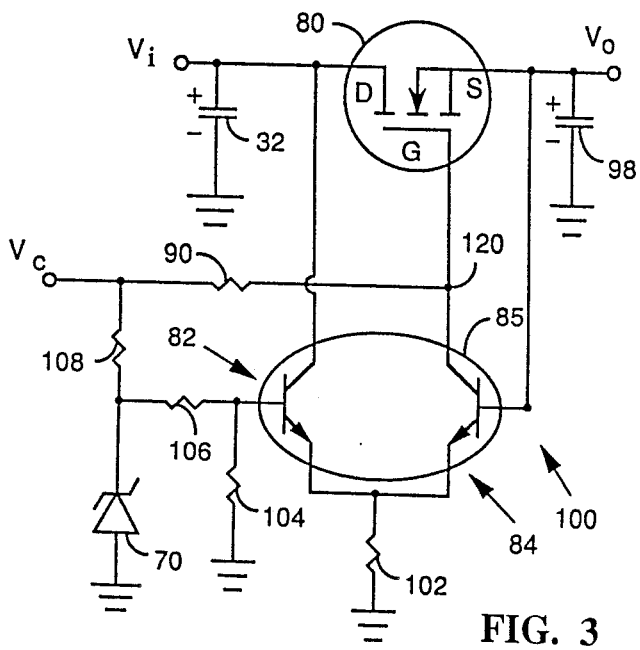

Referring to FIG. 3, there is shown a voltage regulator 100 suitable for providing an output voltage of 5 volts. The voltage regulator 100 of FIG. 3 is used in place of the voltage regulator 28 of FIG. 1 for low voltage applications. The resistors 86 and 88 of FIG. 1 are omitted from the regulator 100 so that the source of the transistor 80 is connected directly to the base of the transistor 84. Therefore the output voltage $V_o$ is equal to the base voltage $V_b$ of the transistor 84.

A resistor 102 preferably having a resistance of about 2.4 KΩ is connected between the emitters of the transistors 82 and 84 and ground. A resistor 104 preferably having a resistance of about 9.76 KΩ is connected between the base of the transistors 82 and ground. A resistor 106 preferably having a resistance of about 2.61 KΩ is connected between the base of the transistor 82 and the cathode of the Zener diode 70. The base voltage of the transistor 82 is given by $$V_{b82} = \frac{6.4\,R_{104}}{R_{104} + R_{106}} \tag{11}$$

The control voltage $V_c$ is applied to a resistor 108 that is connected between the control resistor 90 and the cathode of the Zener diode 70. The resistor 108 preferably has a resistance of about 5.49 KΩ.

The difference amplifier 85 controls the output voltage $V_o$ by maintaining the voltage at the base of the transistor 82 equal to the voltage at the base of the transistor 84. For the 5 volt regulator 100 the ratio of the resistances of the resistors 104 and 106 may be found equating the base voltages of the transistors 82 and 84. Therefore, $$V_{b84} = V_0 = V_{b82} = \frac{6.4\,R_{104}}{R_{104} + R_{106}} \tag{12}$$

which yields $$\frac{R_{106}}{R_{104}} = \frac{6.4\,R}{V_o} - 1. \tag{13}$$

For the fifteen volt regulator, $V_{b83}=6.4$ V, and $$Vb_{84} = \frac{V_o R_{88}}{R_{86} + R_{88}}$$

Equating the base voltages of the transistors 82 and 84 gives the ratio of the resistances of the resistors 86 and 88 as $$\frac{R_{86}}{R_{88}} = \frac{V_o}{6.4} - 1 \tag{14}$$

Resistor 108 in the five volt regulator 100 provides 0.5 ma of current to the Zener and a current of 0.64 ma to the resistors 104 and 106. Therefore, the value of the resistor 108 should be $$R_{108} = \frac{V_c - 6.4}{0.5 + 0.64} = 0.877(V_c - 6.4)K\Omega \tag{15}$$

The control resistor 90 sets a constant bias current of 1.6 to 1.8 ma in the difference amplifier 85. The bias current is given by $$I_{(bias)} = \frac{V_{b82} - 0.65}{R_{102}} \quad (16)$$

The resistor 90 sets the gate-source bias voltage $V_{gs(min)}$ for the transistor 80. The value of $V_{gs(min)}$ must be less than the minimum gate threshold voltage of the transistor 80. The value of $V_{gs(min)}$ is therefore given by $$V_{gs(min)} = V_c - V_o - I_{(bias)}R_{90}. \quad (17)$$

Therefore the resistance of the control resistor 90 may be calculated using $$R_{90} = \frac{V_c - V_o - V_{gs(min)}}{I_{(bias)}} \quad (18)$$

The very high efficiency of the regulator is a result of the low voltage across the power MOS transistor 80. At a 10 amp output current for example, the voltage drop across the transistor 80 is only $$V = R_{ds(on)}I_o = (0.018\ \Omega)\ (10\ \text{amp}) = 0.18\ \text{V}. \quad (19)$$

Therefore, the minimum input voltage for a 5 volt output is 5.18 volts, and the resulting efficiency is 5/5.18 (100)=96.5%. Similarly for the 15 volt regulator, the efficiency is 5/15.18 (100) =98.8%. Existing bipolar regulators require an input of 8 volts to provide a 5 volt output. Therefore, the efficiency of such existing regulators is 5/8 (100)=62.5%, which is much lower than the efficiency of the regulator according to the present invention.

When the power supply 20 of FIG. 1 is operating normally with no overloads, the MOS transistor 80 is in the ohmic conduction region. When the temperature of the current source 30 and the transistor 34 exceed the predetermined value for shutdown, the transistor 34 turns on and becomes conductive. Since the emitter of the transistor 34 is grounded, its collector is also grounded when the transistor 34 turns on. The collector of the transistor 34 is connected at a junction 120 to the gate of the transistor 80 and to the collector of the transistor 84. Therefore, when the transistor 34 turns, on, the junction 120 becomes grounded, which removes the bias voltage from the drain of the transistor 80. When the gate voltage of the transistor 80 is zero, essentially no current flows between the source and drain because of the unavailability of current carriers. After the temperature falls below the cutoff temperature, the transistor 34 turns off; and current flow between the source and drain resumes if all other conditions for operating the power supply are met.

The current limiting circuit 24 turns off the power supply 20 in a manner similar to that described above for the thermal shutdown circuit 22. Since the emitter of the transistor 60 is grounded, its collector is also grounded when the transistor 60 turns on. The collector of the transistor 60 is also connected to the junction 120. Therefore, when the current exceeds a predetermined value, the transistor 60 turns on, which turns off the transistor 80. After the current overload is removed, the transistor 60 turns off; and current flow between the source and drain may resume.

The structures and methods disclosed herein illustrate the principles of the present invention. The invention may be embodied in other specific forms without departing from its spirit or essential characteristics. The described embodiments are to be considered in all respects as exemplary and illustrative rather than restrictive. The appended claims rather than the foregoing description define scope of the invention. All modifications to the embodiments described herein that come within the meaning and range equivalence of the claims are embraced within the scope of the invention.

What is claimed:

1. A power supply having an input terminal and an output terminal for connection between an input voltage source and a load to provide an output voltage and an output current to the load, said power supply comprising:

(a) a MOSFET having a source, a gate and a drain, said source and drain being arranged for connection between the input voltage source and the load;

(b) means connected to said gate of said MOSFET for applying a bias voltage at least equal to the desired output voltage to said gate of said MOSFET to place said MOSFET in a conductive state;

(c) means connected to said bias voltage applying means for providing a reference voltage; and (d) difference amplifier means, connected to said drain and gate of said MOSFET, to said reference voltage providing means, and to said output terminal, for maintaining a fixed ratio between said reference voltage and the output voltage, said difference amplifier means including (i) first and second amplifiers each having first and second terminals and a base, (ii) a first resistor connected between said output terminal and said base of said first amplifier, (iii) a second resistor connected between a ground and said base of said first amplifier, (iv) said first amplifier at said first terminal being connected to said gate of said MOSFET, (v) a third resistor connected between a ground and said second terminals of said respective first and second amplifiers, (vi) said second amplifier at said first terminal being connected to said drain of said MOSFET, and (vii) said second amplifier at said base being connected to said reference voltage providing means such that said difference amplifier means controls the output voltage by maintaining the voltage at said base of said second amplifier substantially equal to the voltage at said base of said first amplifier.

2. The power supply of claim 1, further comprising:

means connected between said input terminal and said drain of said MOSFET for sensing the current that the input voltage source provides to the load; and switch means connected to said current sensing means and to said gate of said MOSFET for placing said MOSFET in a nonconductive state and thereby for switching off the power supply when the current provided to the load, as sensed by said current sensing means, exceeds a predetermined value.

3. The power supply of claim 2 wherein:

said current sensing means includes a comparator connected between said input terminal and said drain of said MOSFET, and a current sense resistor connected between said input terminal and said drain of said MOSFET and connected to said comparator; and said switch means is connected to and controlled by said comparator and connected between said gate of said MOSFET and a ground for placing said MOSFET in a nonconductive state when said comparator produces a signal indicating that the load current has exceeded a predetermined value.

4. The power supply of claim 1, further comprising:

temperature sensing means connected to said input terminal for sensing the operating temperature of said power supply; and thermal shutdown means connected between said temperature sensing means and said gate of said MOSFET for placing said MOSFET in a nonconductive state and thereby switching off the power supply when the operating temperature exceeds a predetermined value.

5. The power supply of claim 4, wherein:

said temperature sensing means is a temperature-dependent electrical signal source connected to said input terminal; and said thermal shutdown means is a switch connected to and controlled by said temperature-dependent electrical signal source and connected between said gate of said MOSFET and a ground for placing said MOSFET in a nonconductive state when said temperature-dependent electrical signal source produces a signal indicating that the operating temperature has exceeded the predetermined value.

* * * * *